US007507698B2

(12) United States Patent
Franzolin et al.

(10) Patent No.: US 7,507,698 B2
(45) Date of Patent: Mar. 24, 2009

(54) TEXTILE ARTICLES FOR WASHING AND CLEANING APPLICATIONS

(75) Inventors: Giorgio Franzolin, Venice (IT); Lucia Rossi, Padua (IT)

(73) Assignee: Reckitt Benckiser N.V., Hoofddorp (NL)

( * ) Notice: Subject to any disclaimer, the term of this patent is extended or adjusted under 35 U.S.C. 154(b) by 176 days.

(21) Appl. No.: 10/504,710

(22) PCT Filed: Feb. 6, 2003

(86) PCT No.: PCT/GB03/00531

§ 371 (c)(1),
(2), (4) Date: Aug. 17, 2004

(87) PCT Pub. No.: WO03/072695

PCT Pub. Date: Sep. 4, 2003

(65) Prior Publication Data

US 2005/0155158 A1 Jul. 21, 2005

(30) Foreign Application Priority Data

Feb. 27, 2002 (GB) ..... 0204532.6

(51) Int. Cl.
*C11D 17/04* (2006.01)

(52) U.S. Cl. ..... 510/295; 510/296; 510/297; 510/220; 510/438; 510/439

(58) Field of Classification Search ..... 510/295, 510/296, 297, 220, 438, 439
See application file for complete search history.

(56) References Cited

U.S. PATENT DOCUMENTS

| | | | | | |
|---|---|---|---|---|---|
| 3,698,095 | A | | 10/1972 | Grand et al. | 34/9 |
| 4,095,946 | A | | 6/1978 | Jones et al. | 8/137 |
| 4,348,293 | A | * | 9/1982 | Clarke et al. | 510/296 |
| 4,410,441 | A | | 10/1983 | Davies et al. | 206/0.5 |
| 4,464,839 | A | | 8/1984 | Sadeh | |
| 4,776,455 | A | * | 10/1988 | Anderson et al. | 206/0.5 |
| 4,820,439 | A | | 4/1989 | Rieck | 252/135 |
| 4,886,615 | A | * | 12/1989 | Dehan | 510/296 |
| 4,931,200 | A | * | 6/1990 | Shanklin et al. | 510/295 |
| 5,004,556 | A | * | 4/1991 | Julemont et al. | 510/304 |
| 5,132,036 | A | * | 7/1992 | Falou et al. | 510/277 |
| 5,780,418 | A | * | 7/1998 | Niinaka et al. | 510/439 |
| 6,174,848 | B1 | | 1/2001 | Dawson et al. | 510/297 |
| 2002/0013251 | A1 | * | 1/2002 | Hayashi et al. | 510/445 |
| 2003/0148914 | A1 | * | 8/2003 | Dasque et al. | 510/447 |

FOREIGN PATENT DOCUMENTS

| | | | |
|---|---|---|---|
| EP | 0 132 726 | A | 2/1985 |
| EP | 0201124 | A2 | 11/1986 |
| EP | 0 253 566 | A | 7/1987 |
| EP | A-384070 | | 8/1990 |
| EP | A-518689 | | 12/1992 |
| EP | A-518720 | | 12/1992 |
| EP | A-544602 | | 6/1993 |
| EP | A-694059 | | 1/1999 |
| EP | 1 126 070 | A | 8/2001 |
| GB | A-1429143 | | 3/1976 |
| GB | A-2358382 | | 7/2001 |
| WO | WO 93/08095 | | 4/1993 |
| WO | WO 97/27743 | | 8/1997 |
| WO | WO 97 32004 | A | 9/1997 |
| WO | WO 99/06522 | | 2/1999 |
| WO | WO 00/55068 | | 9/2000 |
| WO | WO 01/85898 | | 11/2001 |

* cited by examiner

*Primary Examiner*—Lorna M Douyon
(74) *Attorney, Agent, or Firm*—Norris McLaughlin & Marcus, PA

(57) ABSTRACT

A material for use in washing comprising a textile article having a first functionality and a water-soluble container enclosing a composition having a second functionality.

10 Claims, No Drawings

TEXTILE ARTICLES FOR WASHING AND CLEANING APPLICATIONS

The present invention relates to a material for use in washing, said material comprising a textile article.

It is known to use textile articles in washing processes. For example, a textile article is sold which can act as a "dye catcher". Such a textile article is added to a laundry wash and will preferentially bind dye molecules should they be released from clothing being washed. In this way, the inadvertent dyeing of other clothes in the wash is reduced.

We have developed a system of much more general applicability.

The present invention provides a material for use in washing comprising a textile article having a first functionality and a water-soluble container enclosing a composition having a second functionality.

The material of the present invention may, for example, be for adding to a laundry washing machine. In this instance the present invention also provides a method of laundry washing which comprises placing laundry and said material in a laundry washing machine and operating the machine to clean the laundry.

The material of the present invention may also, for example, be for adding to a ware washing machine such as a dishwashing machine. In this instance the present invention also provides a method of ware washing, in particular a method of dishwashing, which comprises placing wares and said material in a dishwashing machine and operating the machine to clean the wares.

The material of the present invention comprises at least two components, the first being the textile article and the second being the water-soluble (which term is taken to include water-dispersible) container. In a washing process, the textile article provides a first functionality, and the water-soluble container provides a second functionality. The functionalities can operate at the same or different stages of the washing process, and can be the same or different. The material of the present invention may also be used to keep apart functionalities which may be incompatible with each other during storage.

The textile article provides a first functionality which can be any functionality desired in the washing process. The textile article can have the first functionality being in the form of a second composition reversibly impregnated therein or deposited thereon. The second composition may be, for example, a fabric care, surface care or dishwashing composition, especially a dishwashing, water-softening, laundry or detergent composition, or a rinse aid. The second composition is generally released at the beginning of the washing process since the textile article is saturated with water at the beginning of the washing process. Thus the second composition is desirably a component which is released at the beginning of the washing process, such as a water-softening composition. However, the second composition can be released at any time during or throughout the washing process if desired.

The first functionality can also be in the form of active moieties bound to the textile article. Such active moieties are generally available throughout the washing process since they are not released from the textile article. Examples of suitable moieties are metal-binding moieties such as calcium-binding moieties or dye complexing moieties.

The textile article is preferably a sheet, for example a woven, knitted or non-woven sheet. The sheet may, if desired, be secured to one or more further sheets, which may be of the same or different material, forming a ply. The textile article may also, for example, be in the form of a thick yarn or braid. Another possibility is for the textile article to be in the form of fibres or filaments, which may, for example, be tied together in a bundle, for example in a tassel or pom-pom. Most preferably the textile article is a fabric sheet of relatively open form, for example a non-woven fabric or a woven fabric of scrim form.

The textile article may, if desired, be contained within a rigid or flexible structure in which liquid inlets and liquid outlets are provided to allow ingress and egress of water. Such a structure may, for instance, be a cloth bag or a plastic cage, or a water-permeable film.

The textile article may be formed from natural or synthetic fibres or a mixture thereof. Suitable materials are polyolefins, poly(haloolefins), insoluble poly(vinyl alcohol), polyesters, polyamides, polyacrylics, protein fibres and cellulosic fibres, for example cotton, viscose and rayon. Preferred are polyolefins, polyacrylics and cellulosic fibres. Polyolefins are especially preferred, particularly polyethylene and polypropylene.

Side chains may be grafted onto the base fibres to provide the desired functionality. A preferred process is one in which the side chains are grafted to the base fibres by irradiation, in an inert atmosphere, with immediate delivery to the irradiated fibres of acrylic acid. Preferably the radiation is electron beam or gamma radiation, to a total dose of 10 to 300 kGy, preferably 20 to 100 kGy. The acrylic acid is preferably of concentration 20 to 80 vol % in water, and the temperature at which the acrylic acid is supplied to the irradiated textile article is preferably an elevated temperature, for example 30 to 80° C. Preferably the base fibres are polyethylene, polypropylene or cellulosic fibres. The reaction to introduce the side-chains may be carried out on the fibres as such or may suitably be carried out on an already-formed textile article, for example a braid or sheet.

The textile article may also be impregnated with or have deposited therein or thereon the composition having the desired functionality. The impregnation or deposition may be carried out on the fibres or on an already-formed textile article, for example a braid or sheet.

In a preferred aspect of this embodiment the textile article may comprise a component reversibly impregnated or deposited onto the textile article. In this embodiment the component may be released instantaneously or over a period of time when exposed to water. The component may be, for example, a water-softening agent able to bind metal ions, in particular calcium ions and/or magnesium ions. More preferably the component is also able to bind other metal ions such as copper ions and/or iron ions. Such a component may be released at a single time or, preferably, over a period of time.

Suitable compositions are, for example, those which give, or improve, water-softening, thereby assisting cleaning. Such components will provide three main types of method of action, described below:

1. Ion exchange agents—such agents include alkali metal (preferably sodium) aluminosilicates, either crystalline, amorphous or a mixture of the two. Such aluminosilicates generally have a calcium ion exchange capacity of at least 50 mg CaO per gram of aluminosilicate, and have the general formula:

$$0.8\text{-}1.5\ Na_2O.Al_2O_3.0.8\text{-}6\ SiO_2$$

and incorporate some water. Preferred sodium aluminosilicates within the above formula contain 1.5 to 3.0 $SiO_2$ units. Both amorphous and crystalline aluminosilicates can be prepared by reaction between sodium silicate and sodium aluminate, as amply described in the literature.

Suitable crystalline sodium aluminosilicate ion-exchange detergency builders are described, for example, in GB-A-1,429,143. The preferred sodium aluminosilicates of this type are zeolites, such as zeolites A and X, and zeolite P as described in EP-A-384,070, and mixtures thereof.

Another class of compounds is the layered sodium silicate builders, such as are disclosed in U.S. Pat. Nos. 4,464,839, 4,820,439 and EP-A-551,375.

These materials are defined in U.S. Pat. No. 4,820,439 as being crystalline layered, sodium silicates of formula:

$$NaMSi_xO_{2x+1}.YH_2O$$

wherein

M is sodium or hydrogen, x is from 1.9 to 4, and y is from 0 to 20.

Literature references describing the preparation of such materials include Glastechn. Ber. 37, 194-200 (1964), Zeitscrift fur Kristallogr. 129, 396-404 (1969), Bull. Soc. Franc. Min. Crist., 95, 371-382 (1972) and Amer. Mineral, 62, 763-771 (1977). These materials also function to remove calcium and magnesium ions from water.

Also covered are zinc salts which have been shown to be effective as water-softening agents.

2. Ion capture agents—agents which prevent metal ions from forming insoluble salts or reacting with surfactants, such as polyphosphates, monomeric polycarbonates such as citric acid or salts thereof, EDTA, aligns, alginates, or imidodisuccinic acid or a salt thereof, such as Baypure CX100.

3. Anti-nucleating agents—agents which prevent seed crystal growth, such as polycarbonate polymers, such as polyacrylates, acrylic/maleic copolymers and acrylic phosphonates, polyaspartic acid polymers or a salt thereof, such as Baypure DS100, and 2-acrylamido-2-methyl propane sulfonic acid polymers.

In a preferred aspect one or more of the above components may be impregnated into the textile fibres.

In a preferred aspect one or more of the above components may be present on the textile article. The components may be deposited on the textile article by dosing a solution to the textile article and removing the solvent, for example by mechanical means, spray drying, evaporation or a combination thereof. Ionic charge may also be used to reversibly bind anionic ionisable ingredients to the textile article.

The textile article can have bound to it such components in the form of particles, such as described above, with those particles not being released from the textile article in use.

Alternatively the textile article could carry on it particles, such as described above, with those particles being washed from the textile article, and dissolved or dispersed in the wash water, in use.

Another possibility is to have a hybrid system in which some particles remain on the textile article and some are washed off during its use.

The washing off of such particles may be rapid, slow or progressive in water. A slow-release system may be attractive in obtaining good activity, for example calcium binding, throughout a cleaning method.

Suitably the textile article has more than one functionality. For example it may have active side chains such as calcium binding side chains, as described above, and a further component, such as the particles or an impregnated component as defined above.

The textile article may, for example, capture anionic species, especially dyes. However, it may also be substantially without means to capture anionic species in the water.

The water-soluble container may be prepared by any desired method. For example it may be prepared by thermoforming, injection-moulding, vertical-form-fill sealing, horizontal-form-fill sealing or by a method which provides pillow packs. The container may comprise one or more compartments. Examples of such containers are described, for example, in GB-A-2,358,382, WO 01/85898, WO 93/08095, EP-A-544,602 and WO 00/55068.

The water-soluble container encloses a composition having a second functionality. The composition having a second functionality may be, for example, a fabric care, surface care or dishwashing composition, especially a dishwashing, water-softening, laundry or detergent composition, or a rinse aid.

The first functionality and the second functionality may be the same or different. The water-soluble container can have any number of different functions, which it can possess singly or in combination. For example, it can ensure that the composition having a second functionality is released at an appropriate time. The composition may, for example, be released at the beginning of the washing process, in the middle or near the end.

The composition having a second functionality is desirably released at a different time or in a different release profile than the first functionality is available from the textile article. Thus the composition having a second functionality may be released all at once and be available during only part of the washing process, whereas the first functionality may be available throughout the washing process. For example, the composition having a second functionality may be a water-softening or enzyme composition which is desirably available only at the beginning of the washing process. The composition having a second functionality may also be a detergent composition which is desirably available during the main washing process. Another possibility is for the composition having a second functionality to be available at the end of the washing process. For example, the composition having a second functionality may be a fabric conditioner or a rinse aid.

In another embodiment, which may, if desired, be combined with the above embodiment, the water-soluble container may contain a composition which should not be directly handled, such as an enzyme or irritant such as a bleach.

The water-soluble container may be prepared from a component which has the desired release profile for the composition having a second functionality. It may, for example, comprise a water-soluble film or moulding comprising a poly (vinyl alcohol) (PVOH), a cellulose derivative such as hydroxypropyl methyl cellulose (HPMC), poly(vinylpyrrolidone) (PVP), poly(acrylic acid) or an ester thereof, poly(maleic acid) or an ester thereof, and gelatin. Copolymers of any of the above may also be used.

PVOH is preferred. The PVOH is water-soluble (which term is taken to include water-dispersible), for example in cold or warm water. By choosing an appropriate PVOH polymer it is possible to ensure that it dissolves at a desired temperature. Thus the PVOH film may be cold water (20° C.) soluble, but may be insoluble in cold water and only become soluble in warm or hot water having a temperature of, for example, 30° C., 40° C., 50° C. or even 60° C. The PVOH may be partially or fully alcoholised or hydrolysed. For example it may be from 40 to 100%, preferably from 70 to 92%, more preferably about 88%, alcoholised or hydrolysed. The degree of hydrolysis is known to influence the temperature at which the PVOH starts to dissolve in water. Modified PVOH polymers such as ethoxylated PVOH may also be used. If desired, the PVOH film may be substantially anhydrous, for example having a water content of less than 5 wt %.

The PVOH film may be produced by, for example, casting or blowing. The film may be a single film. However, it is possible for the film to be in the form of a laminate, for example with another PVOH film or with another polymer such as a cellulose derivative such as hydroxypropyl methyl cellulose (HPMC), poly(vinylpyrrolidone) (PVP), poly (acrylic acid) or an ester thereof, poly(maleic acid) or an ester thereof, and gelatin. Copolymers of any of the above may also be used. The laminate may, for example, have 2, 3, 4, 5 or 6 or more layers.

The PVOH film may consist essentially of, or consist of, the PVOH. It is possible for suitable additives such as plasticisers, lubricants and colouring agents to be added. Components which modify the properties of the polymer may also be added. Plasticisers are generally used in an amount of up to 20 wt %, for example from 10 to 20 wt %. Lubricants are generally used in an amount of 0.5 to 5 wt %. The PVOH is therefore generally used in an amount of from 75 to 84.5 wt %, based on the total weight of the film. Suitable plasticisers are, for example, pentaerythritols such as depentaerythritol, sorbitol, mannitol, glycerine and glycols such as glycerol, ethylene glycol and polyethylene glycol. Solids such as talc, stearic acid, magnesium stearate, silicon dioxide, zinc stearate or colloidal silica may be used as lubricants.

It is also possible to include one or more particulate solids in the film in order to accelerate the rate of dissolution thereof. Dissolution of the solid in water is sufficient to cause an acceleration in the break-up of the film, particularly if a gas is generated.

Examples of such solids are alkali and alkaline earth metal, such as sodium, potassium, magnesium and calcium, bicarbonate and carbonate, in conjunction with an acid. Suitable acids are, for example acidic substances having carboxylic or sulfonic acid groups or salts thereof. Examples are cinnamic, tartaric, mandelic, fumaric, maleic, malic, palmoic, citric and naphthalene disulfonic acids, as free acids or as their salts, for example with alkali or alkaline earth metals.

If the water-soluble container is prepared from a film, the film may have any desired thickness. The film may also, if desired, be laminated. Suitable total thicknesses for the film are 40 to 300 μm, more preferably 80 to 200 μm, especially 100 to 160 μn, more especially 100 to 160 μm and most especially 120 to 160 μm.

The film may be unoriented, mono-axially oriented or bi-axially oriented. In a laminate each film layer may independently be unoriented, mono-axially oriented or bi-axially oriented. If more than one film in the laminate is oriented, they may have the same orientation, or their planes of orientation may be different if desired. The final laminate may also be unoriented, mono-axially oriented or bi-axially oriented.

The composition in the water-soluble container may be any composition which is intended to be released in a washing environment. It may be a composition which is incompatible with the composition on the textile article. It may also be a composition which is incompatible with the atmosphere, for example a hygroscopic component, or a composition which is considered by a consumer to be unpleasant. For example, it may have an unpleasant odour, or may have an unattractive colour, such as yellow, which would not be acceptable when the composition is placed on the textile article, which should generally be white. Consumers may find it inappropriate to place a coloured textile article in a washing process, particularly a laundry washing process.

The composition may, for example, be a fabric care, surface care or dishwashing composition. Thus, for example, it may be a dishwashing, water-softening, laundry or detergent composition, or a rinse aid. Such compositions may be suitable for use in a domestic washing machine. Such compositions are generally packaged in amounts of from 0.5 to 100 g, preferably from 5 to 100 g, especially from 15 to 40 g. For example, a dishwashing composition may weigh from 15 to 30 g, a water-softening composition may weigh from 15 to 40 g, and a laundry composition may weigh from 0.5 to 40 g, preferably from 15 to 40 g.

The composition(s) may be a solid. For example, it may be a particulate or granulated solid, or a tablet. It may also be a liquid, which may be thickened or gelled if desired. The liquid composition may be non-aqueous (i.e. anhydrous) or aqueous, for example comprising less than or more than 5 wt % total or free water. An anhydrous composition generally contains less than 1 wt %, preferably less than 0.5 wt % water. The composition may have more than one phase. For example it may comprise an aqueous composition and a liquid composition which is immiscible with the aqueous composition. It may also comprise a liquid composition and a separate solid composition, for example in the form of a ball, or pill or speckles. The liquid composition may be thickened or gelled.

If the composition is an aqueous liquid having a relatively high water content, for example above 5 wt % water, it may be necessary to take steps to ensure that the liquid does not attack the water-soluble polymer if it is soluble in cold water, or water up to a temperature of, say, 35° C. Steps may be taken to treat the inside surfaces of the container, for example by coating it with agents such as PVdC (poly(vinylidene dichloride)) or PTFE (polytetrafluoroethylene), or to adapt the composition to ensure it does not dissolve the polymer. For example, it has been found that ensuring the composition has a high ionic strength or contains an agent which minimises water loss through the walls of the container will prevent the composition form dissolving the polymer from the inside. This is described in more detail in EP-A-518,689 and WO 97/27,743.

The water-soluble containers may, if desired, have a maximum dimension of 10 cm, especially a maximum dimension of 5 cm excluding any flanges which may be present. For example, a container may have a length of 1 to 15 cm, especially 1 to 5 cm, more especially 3.5 to 4.5 cm, a width of 0.5 to 5 cm, especially 1.5 to 3.5 cm, more especially 2 to 3 cm, and a height of 0.5 to 3 cm, especially 1 to 2 cm, more especially 1.25 to 1.75 cm.

The composition may, for example, comprise a dye complexing agent such as PVNO, which is yellow and has an unpleasant odour and therefore desirably not present on the textile article. Other complexing agents which may be used are polyvinylpyrrolidone (PVP), polyvinylalcohol (PVA), polyvinylimidazole (PVI), polyamine-N-oxides, cationic starches, minerals such as magnesium aluminate and hydrotalcite, polyethylene imines, polyvinyloxazolidones, enzymatic systems such as peroxidases and oxidases, oxidants, surfactants such as cationic, anionic, nonionic or amphoteric surfactants and propylene oxide reaction products.

The composition may, for example, comprise a bleach such as a perborate or percarbonate, particularly an alkali metal perborate or percarbonate such as sodium perborate or percarbonate, or a peroxide, which desirably is not directly handled by a consumer. In this instance it is particularly suitable for the textile article to comprise a complementary composition, for example a bleach booster such as TAED.

The composition may, for example, contain surface active agents such as an anionic, non-ionic, cationic, amphoteric or zwitterionic surface active agents or mixtures thereof.

Examples of anionic surfactants are straight-chained or branched alkyl sulfates and alkyl polyalkoxylated sulfates, also known as alkyl ether sulfates. Such surfactants may be produced by the sulfation of higher $C_8$-$C_{20}$ fatty alcohols.

Examples of primary alkyl sulfate surfactants are those of formula:

$$ROSO_3^-M^+$$

wherein R is a linear $C_8$-$C_{20}$ hydrocarbyl group and M is a water-solubilising cation. Preferably R is $C_{10}$-$C_{16}$ alkyl, for example $C_{12}$-$C_{14}$, and M is alkali metal such as lithium, sodium or potassium.

Examples of secondary alkyl sulfate surfactants are those which have the sulfate moiety on a "backbone" of the molecule, for example those of formula:

$$CH_2(CH_2)_n(CHOSO_3^-M^+)(CH_2)_mCH_3$$

wherein m and n are independently 2 or more, the sum of m+n typically being 6 to 20, for example 9 to 15, and M is a water-solubilising cation such as lithium, sodium or potassium.

Especially preferred secondary alkyl sulfates are the (2,3) alkyl sulfate surfactants of formulae:

$$CH_2(CH_2)_x(CHOSO_3^-M^+)CH_3 \text{ and}$$

$$CH_3(CH_2)_x(CHOSO_3^-M^+)CH_2CH_3$$

for the 2-sulfate and 3-sulfate, respectively. In these formulae x is at least 4, for example 6 to 20, preferably 10 to 16. M is cation, such as an alkali metal, for example lithium, sodium or potassium.

Examples of alkoxylated alkyl sulfates are ethoxylated alkyl sulfates of the formula:

$$RO(C_2H_4O)_nSO_3^-M^+$$

wherein R is a $C_8$-$C_{20}$ alkyl group, preferably $C_{10}$-$C_{18}$ such as a $C_{12}$-$C_{16}$, n is at least 1, for example from 1 to 20, preferably 1 to 15, especially 1 to 6, and M is a salt-forming cation such as lithium, sodium, potassium, ammonium, alkylammonium or alkanolammonium. These compounds can provide especially desirable fabric cleaning performance benefits when used in combination with alkyl sulfates.

The alkyl sulfates and alkyl ether sulfates will generally be used in the form of mixtures comprising varying alkyl chain lengths and, if present, varying degrees of alkoxylation.

Other anionic surfactants which may be employed are salts of fatty acids, for example $C_8$-$C_{18}$ fatty acids, especially the sodium or potassium salts, and alkyl, for example $C_8$-$C_{18}$, benzene sulfonates.

Examples of non-ionic surfactants are fatty acid alkoxylates, such as fatty acid ethoxylates, especially those of formula:

$$R(C_2H_4O)_nOH$$

wherein R is a straight or branched $C_8$-$C_{16}$ alkyl group, preferably a $C_9$-$C_{15}$, for example $C_{10}$-$C_{14}$, alkyl group and n is at least 1, for example from 1 to 16, preferably 2 to 12, more preferably 3 to 10.

The alkoxylated fatty alcohol non-ionic surfactant will frequently have a hydrophilic-lipophilic balance (HLB) which ranges from 3 to 17, more preferably from 6 to 15, most preferably from 10 to 15.

Examples of fatty alcohol ethoxylates are those made from alcohols of 12 to 15 carbon atoms and which contain about 7 moles of ethylene oxide. Such materials are commercially marketed under the trademarks Neodol 25-7 and Neodol 23-6.5 by Shell Chemical Company. Other useful Neodols include Neodol 1-5, an ethoxylated fatty alcohol averaging 11 carbon atoms in its alkyl chain with about 5 moles of ethylene oxide; Neodol 23-9, an ethoxylated primary $C_{12}$-$C_{13}$ alcohol having about 9 moles of ethylene oxide; and Neodol 91-10, an ethoxylated $C_9$-$C_{11}$ primary alcohol having about 10 moles of ethylene oxide.

Alcohol ethoxylates of this type have also been marketed by Shell Chemical Company under the Dobanol trademark. Dobanol 91-5 is an ethoxylated $C_9$-$C_{11}$ fatty alcohol with an average of 5 moles ethylene oxide and Dobanol 25-7 is an ethoxylated $C_{12}$-$C_{15}$ fatty alcohol with an average of 7 moles of ethylene oxide per mole of fatty alcohol.

Other examples of suitable ethoxylated alcohol □on-ionic surfactants include Tergitol 15-S-7 and Tergitol 15-S-9, both of which are linear secondary alcohol ethoxylates available from Union Carbide Corporation. Tergitol 15-S-7 is a mixed ethoxylated product of a $C_{11}$-$C_{15}$ linear secondary alkanol with 7 moles of ethylene oxide and Tergitol 15-S-9 is the same but with 9 moles of ethylene oxide.

Other suitable alcohol ethoxylated non-ionic surfactants are Neodol 45-11, which is a similar ethylene oxide condensation products of a fatty alcohol having 14-15 carbon atoms and the number of ethylene oxide groups per mole being about 11. Such products are also available from Shell Chemical Company.

Further non-ionic surfactants are, for example, $C_{10}$-$C_{18}$ alkyl polyglycosides, such as $C_{12}$-$C_{16}$ alkyl polyglycosides, especially the polyglucosides. These are especially useful when high foaming compositions are desired. Further surfactants are polyhydroxy fatty acid amides, such as $C_{10}$-$C_{18}$ N-(3-methoxypropyl) glycamides and ethylene oxide-propylene oxide block polymers of the Pluronic type.

Examples of cationic surfactants are those of the quaternary ammonium type.

The total content of surfactants in the composition, should the composition be one which comprises surfactants, is desirably 60 to 95 wt %, especially 75 to 90 wt %. Desirably an anionic surfactant is present in an amount of 50 to 75 wt %, the non-ionic surfactant is present in an amount of 5 to 20 wt %, and/or the cationic surfactant is present in an amount of from 0 to 20 wt %. The amounts are based on the total solids content of the composition, i.e. excluding any solvent which may be present.

The composition, particularly when used as laundry washing or dishwashing composition, may also comprise enzymes, such as protease, lipase, amylase, cellulase and peroxidase enzymes. Such enzymes are commercially available and sold, for example, under the registered trade marks Esperesc, Alcalasc and Savinasc by Nova Industries A/S and Maxatasc by International Biosynthetics, Inc. Desirably the enzymes are present in the composition in an amount of from 0.5 to 3 wt %, especially 1 to 2 wt %.

The composition may, if desired, comprise a thickening agent or gelling agent. Suitable thickeners are polyacrylate polymers such as those sold under the trade mark CARBOPOL, or the trade mark ACUSOL by Rohm and Hass Company. Other suitable thickeners are xanthan gums. The thickener, if present, is generally present in an amount of from 0.2 to 4 wt %, especially 0.5 to 2 wt %.

Dishwasher compositions usually comprise a detergency builder. Suitable builders are alkali metal or ammonium phosphates, polyphosphates, phosphonates, polyphosphonates, carbonates, bicarbonates, borates, polyhydroxysulfonates, polyacetates, carboxylates such as citrates, and polycarboxylates. The builder is desirably present in an amount of up to 90 wt %, preferably 15 to 90 wt %, more preferable 15 to 75 wt %, relative to the total weight of the composition. Further details of suitable components are given in, for example, EP-A-694,059, EP-A-518,720 and WO 99/06522.

The compositions can also optionally comprise one or more additional ingredients. These include conventional detergent composition components such as further surfactants, bleaches, bleach enhancing agents, builders, suds boosters or suds suppressors, anti-tarnish and anti-corrosion agents, organic solvents, co-solvents, phase stabilisers, emulsifying agents, preservatives, soil suspending agents, soil release agents, germicides, pH adjusting agents or buffers, non-builder alkalinity sources, chelating agents, clays such as smectite clays, enzyme stabilizers, anti-limescale agents, colourants, dyes, hydrotropes, dye transfer inhibiting agents, brighteners, and perfumes. If used, such optional ingredients will generally constitute no more than 10 wt %, for example from 1 to 6 wt %, the total weight of the compositions.

The builders counteract the effects of calcium, or other ion, water hardness encountered during laundering or bleaching use of the compositions herein. Examples of such materials are citrate, succinate, malonate, carboxymethyl succinate, carboxylate, polycarboxylate and polyacetyl carboxylate salts, for example with alkali metal or alkaline earth metal cations, or the corresponding free acids. Specific examples are sodium, potassium and lithium salts of oxydisuccinic acid, mellitic acid, benzene polycarboxylic acids, $C_{10}$-$C_{22}$ fatty acids and citric acid. Other examples are organic phosphonate type sequestering agents such as those sold by Monsanto under the trade mark Dequest and alkylhydroxy phosphonates. Citrate salts and $C_{12}$-$C_{18}$ fatty acid soaps are preferred.

Other suitable builders are polymers and copolymers known to have builder properties. For example, such materials include appropriate polyacrylic acid, polymaleic acid, and polyacrylic/polymaleic and copolymers and their salts, such as those sold by BASF under the trade mark Sokalan.

The builders generally constitute from 0 to 3 wt %, more preferably from 0.1 to 1 wt %, by weight of the compositions.

Compositions which comprise an enzyme may optionally contain materials which maintain the stability of the enzyme. Such enzyme stabilizers include, for example, polyols such as propylene glycol, boric acid and borax. Combinations of these enzyme stabilizers may also be employed. If utilized, the enzyme stabilizers generally constitute from 0.1 to 1 wt % of the compositions.

The compositions may optionally comprise materials which serve as phase stabilizers and/or co-solvents. Example are $C_1$-$C_3$ alcohols such as methanol, ethanol and propanol. $C_1$-$C_3$ alkanolamines such as mono-, di- and triethanolamines can also be used, by themselves or in combination with the alcohols. The phase stabilizers and/or co-solvents can, for example, constitute 0 to 1 wt %, preferably 0.1 to 0.5 wt %, of the composition.

The compositions may optionally comprise components which adjust or maintain the pH of the compositions at optimum levels. The pH may be from, for example, 1 to 13, such as 8 to 11 depending on the nature of the composition. For example a dishwashing composition desirably has a pH of 8 to 11, a laundry composition desirable has a pH of 7 to 9, and a water-softening composition desirably has a pH of 7 to 9. Examples of pH adjusting agents are NaOH and citric acid.

Any of the above compositions may also be added to the textile article, for example, impregnated therein.

The material of the present invention can, for example, be used to separate different components for various reasons. For instance, components which may lack stability may be separated. Thus the first functionality or the second functionality may be a bleach and the other may be a bleach boaster, one may be a bleach and the other may be an enzyme, one may be a dye transfer inhibitor and the other may be an anionic surfactant, one may be a fabric conditioner and the other may be an anionic surfactant. It may also be desirable to separate components for aesthetic reasons or to provide release at different times or over different time release profiles, for example one may be a bleach and the other may be an enzyme, one may be a fabric conditioner and the other may be a surfactant or one may be a brightener and the other may be a dye fixing agent or DTI. Furthermore, it may be desirable to separate components for safety reasons, such as enzymes from some surfactants.

The material of the present invention may comprise one or more textile articles, which may be the same or different. Desirably the material comprises a single textile article. The material of the present invention may also comprise one or more water-soluble containers. Such containers may have the same or different release profile and/or contain the same or different compositions. Desirably, if more than one container is present, the containers contain different compositions, for example compositions which are incompatible with each other. The containers may also have different release profiles, for example to release one composition at one stage of the washing process and another composition at another stage.

The material of the present invention may also comprise other components, such as a handle which does not become saturated with water during the washing process for easy handling, or a hook for attaching the material to the inside of a washing machine, in particular a ware-washing machine.

The material of the present invention may be prepared by simply attaching the textile article and the water-soluble container. They may be permanently attached (until the water-soluble container dissolves), or removably attached. Suitably the textile article and water-soluble container are attached by an adhesive. A suitable adhesive is water or an aqueous solution of the polymer from which the walls of the water-soluble container are formed. They my also be attached by other means, such as by heating using gentle pressure and heat, for example a pressure of about 1 Kg/cm and a temperature of 130 to 140° C.

It is also possible to prepare the material of the present invention by forming the water-soluble container around or through the textile article. For example, the water-soluble container can be formed around part or all of the textile article from any of the polymers mentioned above as well as components, particularly polymers or coating agents, which have no or little inherent strength or no film-forming properties, such as a PEG.

The material of the present invention may have any desired physical form. Thus, for example, it may comprise a textile article in the form of a sheet, particularly a rectangular sheet, with the water-soluble container placed near an edge. The water-soluble container is more suitably placed at a corner, or is elongate and extends at least partly along one edge. When packaged the textile article may, if desired, be wrapped around the water-soluble container to provide a certain degree of protection from knocks, and to act as a reservoir for the composition inside the water-soluble container should it burst or leak before use. The material of the present invention may also comprise one or more textile articles surrounded partly or, more desirably, completely be a water-soluble coating The material of the present invention may be packaged in outer containers if desired, for example either singly or in a ply of two or more sheets, The present invention is further explained in the following Examples:

EXAMPLES

Example 1

A wipe containing a bleach booster for greasy and oxidizable soils and intended to be added to a laundry wash was prepared. Non woven sheets, measuring 12×5.7 cm, with a basis weight of 90 g/m$^2$, made out of the 70% rayon and 30% polyester, were impregnated by dipping them in a solution consisting of 7.9% PEG1500, 12% PEG4000, 8% PEG6000 and 73% aliphatic ethoxylated alcohol ($C_{13-15}$, AO7). To increase the fluidity of the solution, the components were gently heated together. The sheets absorbed about 10 grams of the solution.

Using conventional heat sealing technology, two compartment pouches having dimensions of 12×2×1 cm were made out of 70 μm thick poly(vinyl alcohol) film and filled with 12.4 g of percarbonate in one compartment (length 8 cm) and 2.6 g TAED in the other (length 4 cm). After the sheets had dried, the sachets were attached to the top of them by heating sealing.

Example 2

A bleach boaster on a wipe was prepared for greasy, proteolytic and oxidisable soil, to be added to a laundry wash. The process of Example 1 was repeated except that 0.4 g of Enzyme 45 was included in the smaller compartment along with the TAED.

Example 3

A DTI on a wipe was prepared. 2.4 g of a 20% w/w water solution of polyvinylpyridine-N-oxide (PVNO) were sprayed on to 30.00 g of zeolites 4A, which had previously been dried in an oven at 150° C., while mixing in a powder mixer. The thus obtained powder composition was ground in a grinder.

Using conventional heating sealing technology, pouches having dimensions of 9×1.5×0.3 cm were prepared from 70 μm thick poly(vinyl alcohol) film and filled with 6 g of the powder composition. The sachets were then attached by means of heat sealing onto the top of nonwoven sheets having dimensions of 11.5×21 cm of cellulose based quaternerised fabric having a basis weight of 75 g/m$^2$.

Example 4

A DTI on a wipe was prepared. 7.63 g of a 20% w/w water solution of polyvinylpyridine-N-oxide (PVNO) were sprayed onto 30.00 g of sodium citrate which had previously been dried in an oven at 150° C. The thus obtained powder composition was ground in a grinder.

Using conventional heating sealing technology, pouches having dimensions of 9×1.5×0.3 cm were prepared from 70 μm thick poly(vinyl alcohol) film and filled with 6 g of the powder composition. The sachets were then attached by means of heat sealing onto the top of nonwoven sheets having dimensions of 11.5×21 cm of cellulose based quaternerised fabric having a basis weight of 75 g/m$^2$.

The invention claimed is:

1. A material for use in washing comprising a textile article having a first functionality and attached to the textile article a water-soluble container enclosing a composition having a second functionality wherein the textile article has dye complexing moieties bound to the textile article which are not released from the textile article in use, wherein the dye complexing moieties comprise polyvinylpyridine-N-oxide, and the second functionality comprises a water-softening composition, a bleach booster, a bleach, an enzyme or a dye complexing agent.

2. A material according to claim 1 wherein the textile article has a composition having a first functionality reversibly impregnated therein or deposited thereon.

3. A material according to claim 1 wherein the textile article is a cloth.

4. A material according to claim 1 wherein the water-soluble container has walls formed from a poly(vinyl alcohol) or cellulose derivative.

5. A material according to claim 1 wherein the composition having a second functionality is in solid form.

6. A material according to claim 1 which comprises the textile article partly or completely surrounded by the water-soluble container.

7. A material according to claim 1 which is for adding to a laundry washing machine.

8. A material according to claim 1 which is for adding to a ware washing machine.

9. A method of laundry washing which comprises the steps of:

placing laundry and a material according to claim 7 in a laundry washing machine; and operating the machine to clean the laundry.

10. A method of ware washing which comprises the steps of:

placing wares and a material according to claim 8 in a ware washing machine; and operating the machine to clean the wares.

* * * * *